US005127927A

United States Patent [19]

Holmes et al.

[11] Patent Number: 5,127,927

[45] Date of Patent: Jul. 7, 1992

[54] FLOW FILTER DEVICE

[75] Inventors: Richard W. Holmes, Westport, Conn.; Jaime A. Escobar, Lincoln Park, N.J.

[73] Assignee: Environet, Inc., New York, N.Y.

[21] Appl. No.: 765,549

[22] Filed: Sep. 25, 1991

[51] Int. Cl.[5] ..... B01D 46/10

[52] U.S. Cl. ..... 55/313; 55/420; 55/500; 137/527.8

[58] Field of Search ..... 55/210, 211, 213, 302, 55/309-314, 385.2, 420, 500; 98/31.5, 34.5; 137/527.8

[56] References Cited

U.S. PATENT DOCUMENTS

| | | | |
|---|---|---|---|
| 2,983,213 | 5/1961 | Bohanon | 98/34.5 |
| 2,992,701 | 7/1961 | White . | |
| 3,756,416 | 9/1973 | Wood . | |
| 4,217,116 | 8/1980 | Seever . | |
| 4,312,645 | 1/1982 | Mavros et al. . | |
| 4,356,007 | 10/1982 | Bowman . | |
| 4,726,825 | 2/1988 | Natale | 55/420 X |
| 4,744,409 | 5/1988 | Benner | 137/527.8 X |
| 4,804,392 | 2/1989 | Spengler | 55/385.2 X |
| 4,817,644 | 4/1989 | Holmes et al. . | |
| 4,963,170 | 10/1990 | Weber et al. . | |
| 5,004,483 | 4/1991 | Eller et al. | 55/385.2 X |
| 5,053,064 | 10/1991 | Hama et al. | 55/309 X |

*Primary Examiner*—Charles Hart

*Attorney, Agent, or Firm*—Foley & Lardner

[57] ABSTRACT

An air flow filter device includes a housing having at least two openings therein, a stationary air filter, such as an HEPA filter, disposed within the housing, and a one-way air flow valve disposed within the housing in parallel with the filter. The valve is positioned such that sufficient air flowing into the housing from the one opening closes the valve so that such air flows through the filter in order to exit through the other opening, and such that sufficient air entering the housing from the other opening opens the valve so that the air flows through the valve in order to exit through the one opening. In this manner, air may be circulated in both directions without escape of contaminants, such as asbestos fibers, into the environment.

17 Claims, 3 Drawing Sheets

FLOW FILTER DEVICE

TECHNICAL FIELD

This invention relates to filter devices, particularly to high efficiency particulate air (HEPA) flow filter devices for use in areas such as work spaces contaminated with friable articles such as asbestos, fibers and the like.

BACKGROUND OF THE INVENTION

The removal and disposal of extremely hazardous materials, such as carcinogenic, friable asbestos-containing materials, from building components is of great importance. The removal of such material, while necessary for safety reasons, is, however, an inevitably dangerous process. Removal or abatement processes are also generally regulated by state, local and federal environmental standards, which relate in part to the isolation and decontamination assemblies for such abatement methods.

One known abatement method requires the particularly expensive and time-consuming erection and use at the asbestos removal site of a complete multi-layer isolation and decontamination assembly within the building. This assembly includes a number of separate functional chambers, interconnected airlocks, asbestos removal equipment storage areas, clean rooms with triple flap curtains on each, isolated personnel decontamination showers and constantly operable high capacity HEPA filter systems. This method typically utilizes overlapping polyethylene sheets between the work area and each section of the decontamination chamber. Air moving into the work area responsive to the operation of negative air machines moves through the overlapping sheets. The sheets are arranged to stop contaminated air in the work area from passing out of the work area any time the negative air pressure in the work area is lost. The sheets also prevent positive pressure from occurring in the work area, causing contaminated air from the work area to pass outwardly. This method typically requires constant and precise monitoring of both the interior of the isolation and decontamination assembly to insure that the asbestos fiber concentration level within does not exceed a predetermined level.

Small scale asbestos removal apparatus such as glove bags and the like are also known and generally also require the use of HEPA air filtration systems.

The inventors herein have previously invented an apparatus and method for the safe and effective, large scale removal and disposal of hazardous materials from building components as set forth in U.S. Pat. No. 4,817,644, issued Apr. 4, 1989 to Holmes et al. In that patent, a new and improved apparatus and method for the removal of friable asbestos-containing materials from building components is provided which includes a sheet-like body member and one or more generally elongated, close-ended chutes operatively connected to the body member. In use, the body member is sealed around the building component from which hazardous material is to be removed, and then the hazardous material is moved into the belly of the body member and through the chutes for periodic packaging and disposal. In that method and apparatus, an HEPA negative pressure system is connected to the body member, enabling the constant replenishment of air from the ambient surroundings and preventing collapse of the enclosure as contaminated air from within the enclosure is withdrawn through use of a vacuum source. The vacuum source also includes a HEPA filtering system.

One known HEPA vent filter device comprises a housing having openings in front and back walls, a partition in the housing between the front and back walls defining a framed opening, an extensible wall on the exterior of the housing between the front and back walls, and a HEPA filter pivotally mounted for movement toward and away from the framed opening. See, U.S. Pat. No. 4,963,170, issued Oct. 16, 1990 to Weber et al. When a reduced pressure of a previously determined amount is applied to the pivoting filter, the filtering element is sealed between a knife edge and allows unfiltered air to flow into the work area. Upon loss of negative pressure, gravity causes the filter to rotate to a closed position to filter any reverse airflow. There are various problems with this design. First, this vent filter device is a multi-part construction. This leads to difficulties in manufacture and use. The numerous moving parts are each susceptible to wear, resulting in a typically short life span for the device.

Second, the HEPA filter's life span itself has been found to be very short in this design. In the Weber et al. design, the HEPA filter is susceptible to damage because the filter is sealed between a knife edge. That design requires the operator to remove and package the HEPA filter after each use in order to increase the life span, and such constant removal tends to cause damage to the HEPA filter because of its orientation with respect to the knife edge. The HEPA filter is one of the most expensive parts of the filter device.

Third, the filter device of Weber et al. relies on gravity and pressure to open and close the filter, and thus, it must be positioned upright in order to work properly. If the device is positioned incorrectly, gravity may hold the HEPA filter open at negative pressures. The weight of the HEPA filter makes this design particularly susceptible to such problems.

Thus, there is a need for a filtering system with this design which is capable of repeated, versatile, and efficient use.

Other filtering systems, not known for use in the removal of asbestos or other hazardous materials, are known wherein the filter element is movable from an operative position to a bypass position. See, for example, U.S. Pat. Nos. 4,356,007, issued Oct. 26, 1982 to Bowman, 4,312,645, issued Jan. 26, 1982 to Mavros et al. and 2,992,701, issued Jul. 18, 1961 to White.

Filtering systems wherein a filter panel is used to collect particulate material and thereafter selectively removed are also known, as shown in U.S. Pat. Nos. 3,756,416, issued Sep. 4, 1973 to Wood and 4,217,116, issued Aug. 12, 1980 to Seever. None of these known filtering systems or devices, however, are known to be useful in the removal of asbestos or other hazardous materials or overcome the deficiencies of known filters for that use.

SUMMARY OF THE INVENTION

The present invention provides a HEPA flow filter device not subject to the disadvantages of the prior art. Specifically, the invention, rather than relying on a movable filter element, utilizes a separate valve to bypass the HEPA filter element. A HEPA flow filter mounted in parallel with a one-way air flow valve in a filter housing having air flow openings on opposite sides of the filter and valve, in accordance with the invention, avoids the necessity of a movable HEPA filter element, and yet allows the HEPA filter element to be bypassed. In one preferred embodiment, the filter device housing includes back, front, top, bottom and side walls. The front wall includes the valve and filter. In another embodiment, the filter device has an interior central wall which includes the valve and filter.

BRIEF DESCRIPTION OF THE DRAWINGS

Preferred embodiments of a flow filter device in accordance with the invention will be described in conjunction with the appended drawings, wherein like numerals denote like elements, and.

DETAILED DESCRIPTION OF PREFERRED EXEMPLARY EMBODIMENTS

Figure 1:
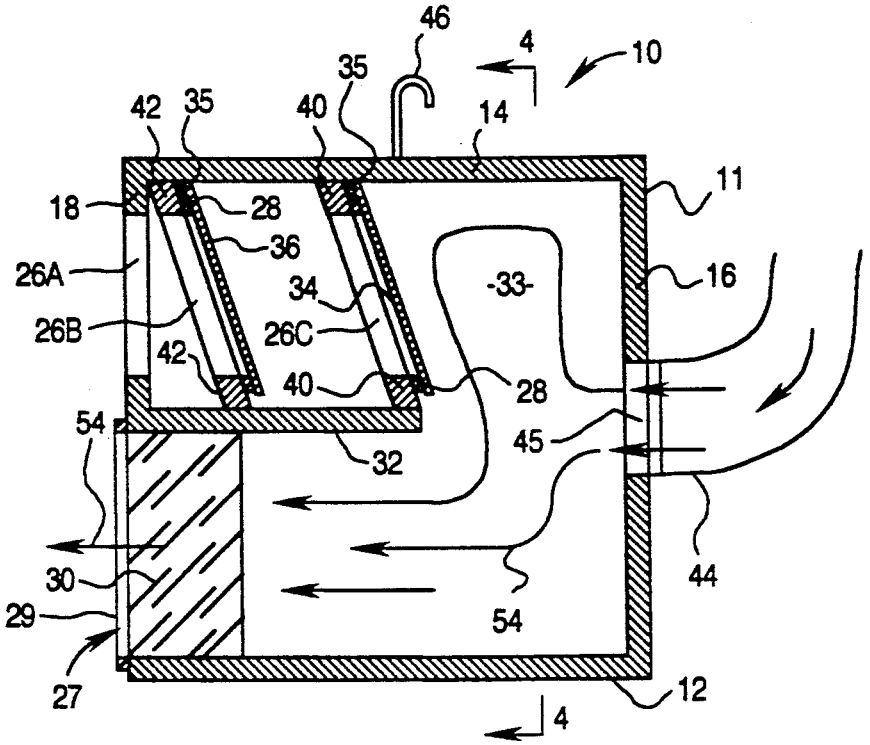
FIG. 1 is a lengthwise sectional view of a filter device according to the invention in the stationary and positive pressure positions.

With reference to FIGS. 1 to 4, a flow filter device 10 in accordance with one embodiment of the invention comprises an enclosure or housing 11 having a bottom wall 12, a top wall 14, a back wall 16, a front wall 18 and respective side walls 20 and 22, each of which is sealed air-tight to each adjacent wall. Preferably, all of the walls of housing 11 are formed of fiberglass and have a thickness in the range of 0.5" to 0.75" and a height in the range of 4 to 36 inches.

Front wall 18 has a generally rectangular intake opening 26A. A first, angled rectangular fiberglass frame 42 extends inwardly at an acute angle relative to front wall 18, forming a rectangular valve opening 26B in alignment with opening 26A. Frame 42 is secured in an air-tight fashion to walls 20, 22 along its sides, to the inside of top wall 14 along its top, and to a horizontal partition wall 32 along its bottom to form a valve enclosure. A second, angled rectangular fiberglass frame 40 rearwardly spaced from frame 42 also extends inwardly at an acute angle relative to front wall 18, in parallel with frame 42, forming a second rectangular valve opening 26C in alignment with openings 26A, 26B. Openings 26B and 26C are bounded by rubber gaskets 28 disposed on the inner faces of frames 40, 42 and which surround the perimeter of each opening 26B, 26C.

Front wall 18 also includes a filter element 30 secured in a lower rectangular opening 27 therein. Filter 30 is preferably a high efficiency particulate air ("HEPA") filter of the type useful in asbestos abatement procedures, such as a 99.97% efficiency HEPA filter. Filter 30 is suitably sealed by press-fitting into snug engagement with bottom wall 12, front wall 18, side walls 20 and 22, and the underside of partition wall 32. Filter 30 is preferably also press-fitted into snug engagement with a gasket 23 provided between partition wall 32 and bottom wall 12. Preferably, gasket 23 is formed of any suitable rubber or other polymeric material. Alternatively, filter 30 can be secured to walls 12, 20 and 22 by any suitable means, such as fasteners or a contact adhesive. In any event, filter 30 should be easily removable from device 10.

A grate 29 preferably is provided to hold filter 30 in place. Grate 29 is attached to front wall 18 between partition 32 and bottom 12 to overlie and retain filter 30. Grate 29 preferably has a configuration which readily allows filtered air to pass from device 10 to the environment. As shown best in FIG. 3, grate 29 preferably comprises a plurality of horizontally aligned slats, but other configurations may be used. For example, grate 29 simply may be a frame without the slats. Grate 29 is easily removable from device 10 such that filter 30 can be easily removed for replacement when filter 30 becomes worn or otherwise clogged.

Horizontal partition 32 is parallel to top wall 14 and bottom wall 12, and extends from front wall 18 towards rear wall 16, spanning side walls 20, 22. Partition 32 preferably extends from about ¼ to ½ the distance between front and back walls 16, 18, forming a common rear space 33 within housing 11.

Figure 4:
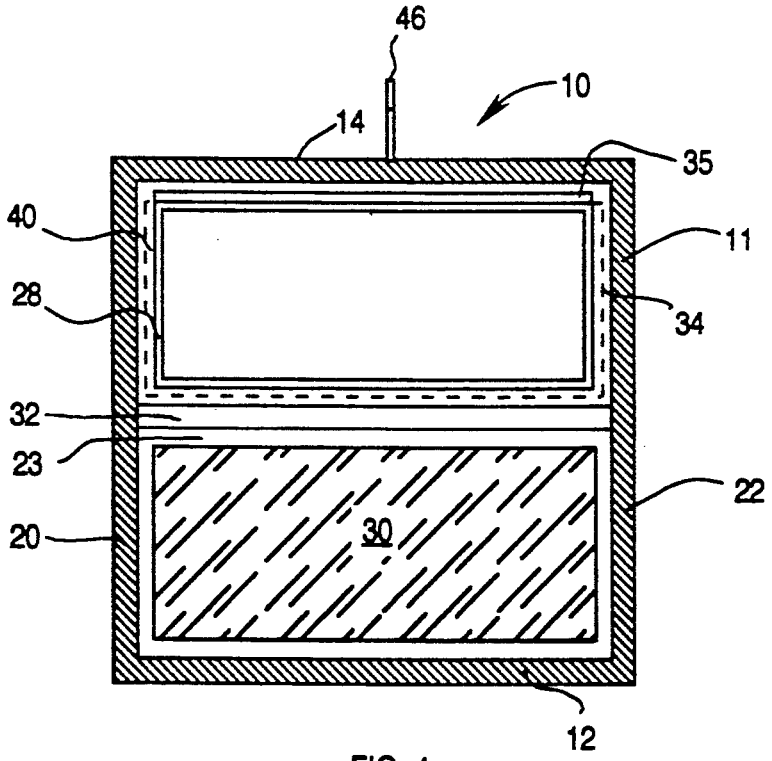
FIG. 4 is a widthwise sectional view taken along the line 5—5 in FIG. 1.

Referring to FIGS. 1 and 4, a pair of spaced, parallel, one-way fiberglass valve flaps or doors 34, 36 are pivotally secured along the top edge of each of frames 40, 42, respectively, by hinges 35. Flaps 34, 36 extend from near top wall 14 and to near partition 32. In stationary position (FIG. 1), gravity causes flaps 34 and 36 to rest against gaskets 28 on the rear faces of frames 40 and 42. Flaps 34, 36 swing inwardly to an open position shown in FIG. 2. As an alternative to the hinged rigid fiberglass panels shown, flaps 34, 36 could comprise other rigid metal or polymeric material, or similar one-way air flow doors, such as flexible plastic flaps that open by bending.

A manifold 44 is removably attached to back wall 16 over a rear opening 45 in wall 16. Manifold 44 attaches filter device 10 to a sealed work area, such as an asbestos removal environment.

Optionally, a hook 46 is secured to top wall 14. Hook 46 enables filter device 10 to be attached to pipes adjacent device 10, a feature particularly useful when device 10 is used in conjunction with small scale glove bags.

Figure 2:
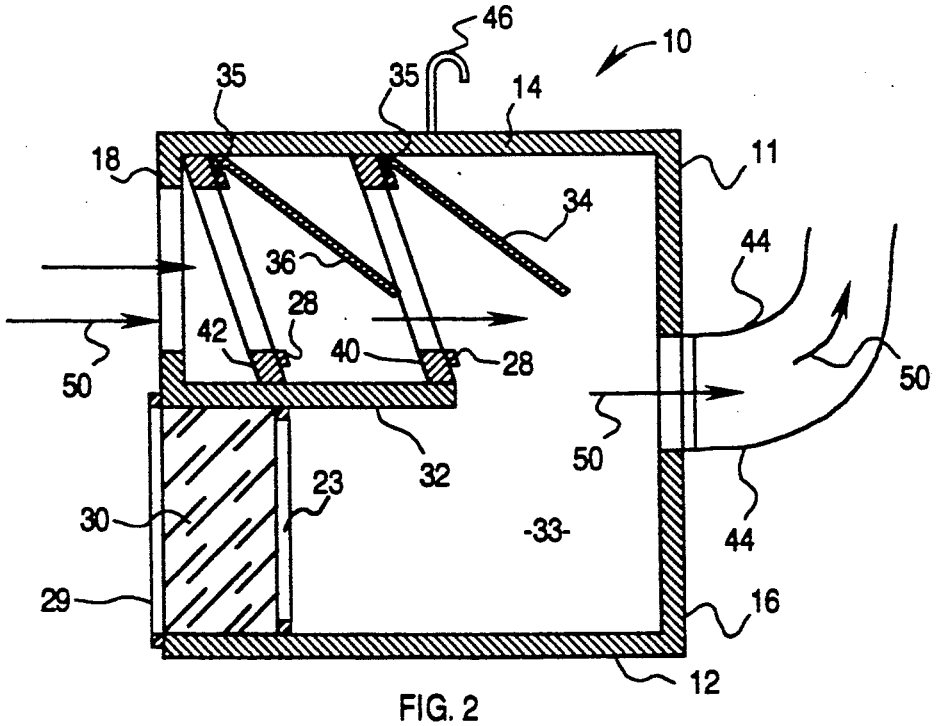
FIG. 2 is the same view as FIG. 1, showing the negative air pressure position.
Figure 3:
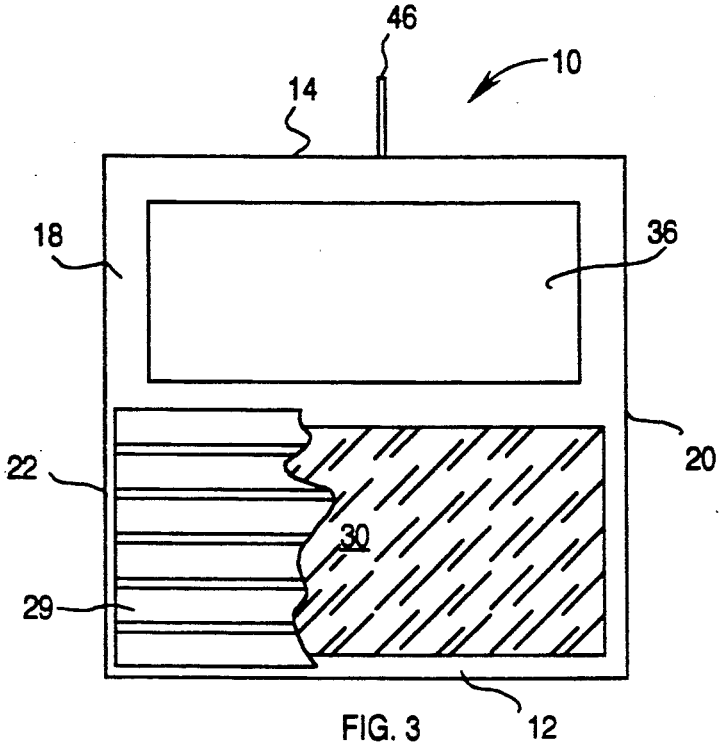
FIG. 3 is a front view of the filter device of FIG. 1.

Filter device 10 is preferably used in asbestos abatement procedures to facilitate a negative air pressure in the work area and prevent contaminated air, i.e., air including friable asbestos-containing materials, from escaping to the environment. When the outside and inside pressures are equal, flaps 34 and 36 are in stationary position as shown in FIG. 1. However, when make up air, denoted by arrows 50 in FIG. 2, is drawn into the work area, it first passes through openings 26A, 26B, 26C as shown. The air flow lifts flaps 34, 36 off of frames 40, 42. Clean air thus flows into space 33, then into manifold 44 and ultimately into the work area. Clean air flow 50 thus bypasses filter 30 due to its greater air flow resistance.

Under operating conditions, air contained in the work area will need to pass out to the environment. When contaminated air, denoted by arrows 54 in FIG. 1, flows from the work area into space 33 of filter device 10, the pressure inside filter device 10 exceeds the pressure outside filter device 10. This difference in pressure forces flaps 34, 36 against gaskets 28 on frames 40, 42. When flaps 34 and 36 are pushed against frames 40 and 42, front opening 26A is effectively sealed. Contaminated air 54 is thus forced through HEPA filter 30. As this occurs, contaminants such as friable asbestos-containing materials are removed and retained in filter 30.

Figure 5:
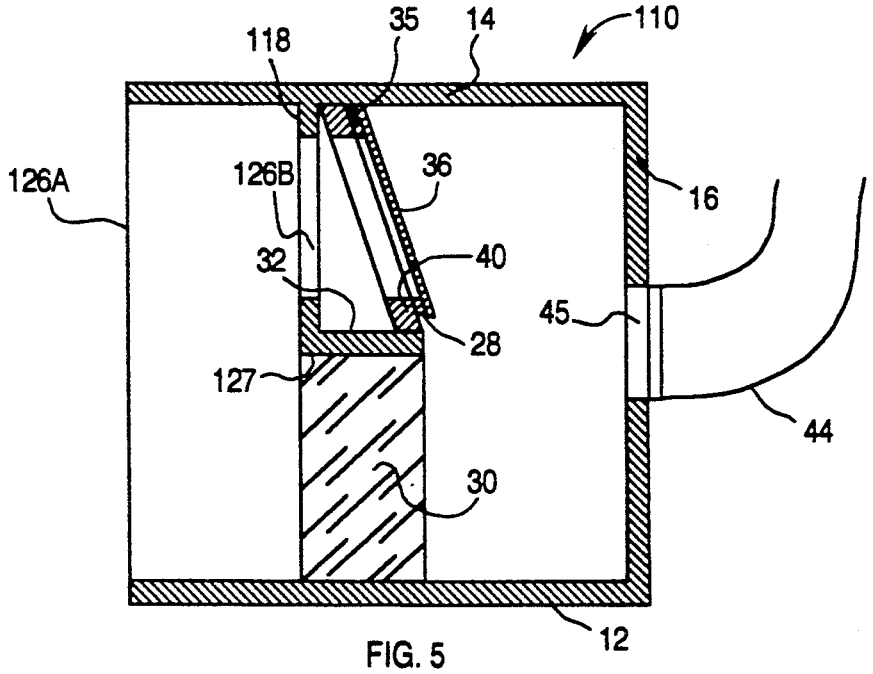
FIG. 5 is a lengthwise sectional view of an alternative embodiment of a filter device according to the invention.

In the alternative embodiment of a filter device 110 shown in FIG. 5, front wall 18 is omitted and replaced with a vertical partition half-wall 118 centrally located in a recessed position about half-way between the front opening 126A of device 110 and rear wall 16. Wall 118 has an upper valve intake opening 126B covered by a single flap 36 with a frame 42 provided with a gasket 28, as described above. Filter 30 fits into an opening 127 beneath half-wall 118. This embodiment protects the filter and flap assembly better by positioning these parts inside of the housing, and is particularly suited for glove bag and surface closures.

The above description is of preferred embodiments of the invention and is not limited to the specific forms shown. Numerous possible placements for openings, manifolds and flaps on the filter device of the invention are possible. Although flap-type valves were used as one-way valves in this application, various one-way valves are known to and will hereafter be devised by those skilled in the art, each of which could be used without departing from the spirit of the invention. These and other modifications may be made in the design and arrangement of the elements within the scope of the invention, as expressed in the appended claims.

We claim:

1. An air flow filter device, comprising:

a housing having first and second openings therein;

an air filter disposed within said housing; and a one-way air flow valve disposed within said housing in parallel with said filter, said valve being positioned such that sufficient air flowing into said housing from said second opening closes said valve so that such air flows through said filter in order to exit through said first opening, and such that sufficient air entering said housing from said first opening opens said valve so that air which flows through said valve bypasses said filter and can exit the device through said second opening.

2. The filter device of claim 1, wherein said housing comprises a top wall, a bottom wall, a pair of opposed side walls spanning said top and bottom walls, a front wall and back wall, wherein said first opening is formed in said front wall and said second opening is formed in said back wall.

3. The filter device of claim 2, said first opening comprises a pair of spaced openings in said front wall, said air flow valve being mounted in one of said openings and said filter being mounted in the other.

4. The filter device of claim 2, wherein said filter and said valve are disposed side-by-side in a recessed position within said housing between said first and second openings.

5. The filter device of claim 1, wherein said filter comprises an HEPA filter.

6. The filter device of claim 1, further comprising a manifold connected to said second opening for attachment of an asbestos glove bag or other asbestos abatement environment to said filter device.

7. The filter device of claim 1, wherein said one-way valve comprises a flap which pivots away from an associated air flow valve opening in response to a sufficient air flow entering said housing through said first opening, and which covers said valve opening in response to a sufficient air flow through said second opening.

8. The filter device of claim 7, wherein said one-way valve further comprises a frame having the valve opening therein, a gasket on an inner surface of said frame disposed about the periphery of the valve opening for air-tight engagement with said flap, and a hinge along one edge on which one end of said flap is mounted.

9. The filter device of claim 8, wherein said frame is disposed at an acute angle relative to a vertical operating position of said filter device so that gravity causes said flap to assume a closed rest position.

10. The filter device of claim 9, wherein said valve further comprises a partition wall from which said rectangular frame extends, which partition wall separates said valve from said filter.

11. An air flow filter device, comprising:

a housing having a rear wall with a rear opening therein, a front wall with a front filter opening and a front intake opening therein, and a partition wall within the housing, which partition wall extends rearwardly from the front wall from a position between the filter opening and the intake opening part way towards the rear wall, thereby defining a common space rearwardly of the partition wall between the partition wall and the rear opening;

a filter disposed on one side of the partition wall so that air entering the housing through the rear opening and leaving the housing through the front filter opening must pass successively through the common space, the filter, and the front filter opening; and a one-way valve disposed on the other side of the partition wall from the filter in parallel therewith so that air entering the housing through the front intake opening and leaving the housing through the rear opening must pass successively through the front intake opening, the one-way valve, and the common space, and wherein the one-way valve prevents air entering the housing through the rear opening from leaving through the intake opening.

12. The filter device of claim 11, wherein the filter comprises a HEPA filter.

13. The filter device of claim 11, wherein a grate is disposed over the filter opening for holding the filter in place, and the filter is disposed in the filter opening behind the grate.

14. The filter device of claim 12, further comprising a manifold in communication with the rear opening for attachment of an asbestos glove bag or other asbestos abatement environment to the filter device.

15. The filter device of claim 11, wherein the valve comprises a flap which lifts away from an associated valve opening in response to sufficient air flow into the housing through the intake opening, and which flap presses against and covers the valve opening in response to a sufficient air flow into the housing through the rear opening.

16. The filter device of claim 15, wherein the valve further comprises a frame having the valve opening therein, a gasket on an inner surface of the frame disposed about the periphery of the valve opening for airtight engagement with the flap, and a hinge on which one end of the flap is mounted.

17. The filter device of claim 16, wherein the frame is disposed at an acute angle relative to a vertical operating position of the filter device so that gravity causes the flap to assume a closed rest position.

* * * * *